US011264220B2

(12) United States Patent
Bautista-Salvador et al.

(10) Patent No.: US 11,264,220 B2
(45) Date of Patent: Mar. 1, 2022

(54) METHOD FOR PRODUCING AN ATOM TRAP, AND ATOM TRAP

(71) Applicant: BUNDESREPUBLIK DEUTSCHLAND, VERTRETEN DURCH DAS BUNDESMINISTERIUM FÜR WIRTSCHAFT UND ENERGIE, DIESES VERTRETEN DURCH DEN PRÄSIDENTEN DER PHYSIKALISCH-TECHNISCHEN BUNDESANSTALT, Braunschweig (DE)

(72) Inventors: Amado Bautista-Salvador, Braunschweig (DE); Christian Ospelkaus, Hannover (DE); Martina Wahnschaffe, Braunschweig (DE); Jonathan Morgner, Garbsen (DE)

(73) Assignee: Bundesrepublik Deutschland, vertreten durch das Bundesministerium fuer Wirtschaft und Energie, dieses vertreten durch den Praesidenten der Physikalisch-Technischen Bundesanstalt, Braunschweig (DE)

( * ) Notice: Subject to any disclaimer, the term of this patent is extended or adjusted under 35 U.S.C. 154(b) by 0 days.

(21) Appl. No.: 17/053,504

(22) PCT Filed: Mar. 4, 2019

(86) PCT No.: PCT/EP2019/055314

§ 371 (c)(1),
(2) Date: Nov. 6, 2020

(87) PCT Pub. No.: WO2019/214863

PCT Pub. Date: Nov. 14, 2019

(65) Prior Publication Data

US 2021/0233756 A1 Jul. 29, 2021

(30) Foreign Application Priority Data

May 9, 2018 (DE) ..... 10 2018 111 220.3

(51) Int. Cl.
*H01J 49/00* (2006.01)
*H01J 3/00* (2006.01)

(52) U.S. Cl.
CPC ..... *H01J 49/0018* (2013.01); *H01J 3/00* (2013.01)

(58) Field of Classification Search
CPC . H01J 3/00; H01J 3/40; H01J 49/0018; H01L 49/00; H01L 49/02
See application file for complete search history.

(56) References Cited

U.S. PATENT DOCUMENTS 7,928,375 B1 * 4/2011 Mangan ..... H01J 49/0018 250/292
10,141,177 B2 * 11/2018 Muntean ..... H01J 49/062
2017/0316335 A1 11/2017 Kim et al.

FOREIGN PATENT DOCUMENTS

WO WO-2007052273 A2 * 5/2007 ..... G06N 10/00

OTHER PUBLICATIONS

Allcock et al, "Implementation of a symmetric surface-electrode ion trap with field compensation using a modulated Raman effect", New Journal of Physics, 12 (2010) 053026.

(Continued)

*Primary Examiner* — Brooke Purinton
(74) *Attorney, Agent, or Firm* — WC&F IP

(57) ABSTRACT

A method for producing an atom trap (20) comprising the steps: (a) applying an electrically conductive starting layer (2) onto a substrate (1), (b) applying at least one electric conductor element (4) to the starting layer (2) by means of electro-chemical deposition and/or a lift-off method, (c) applying at least one contacting element (6) by means of electro-chemical deposition and/or a lift-off method, such (Continued)

Figure 1:
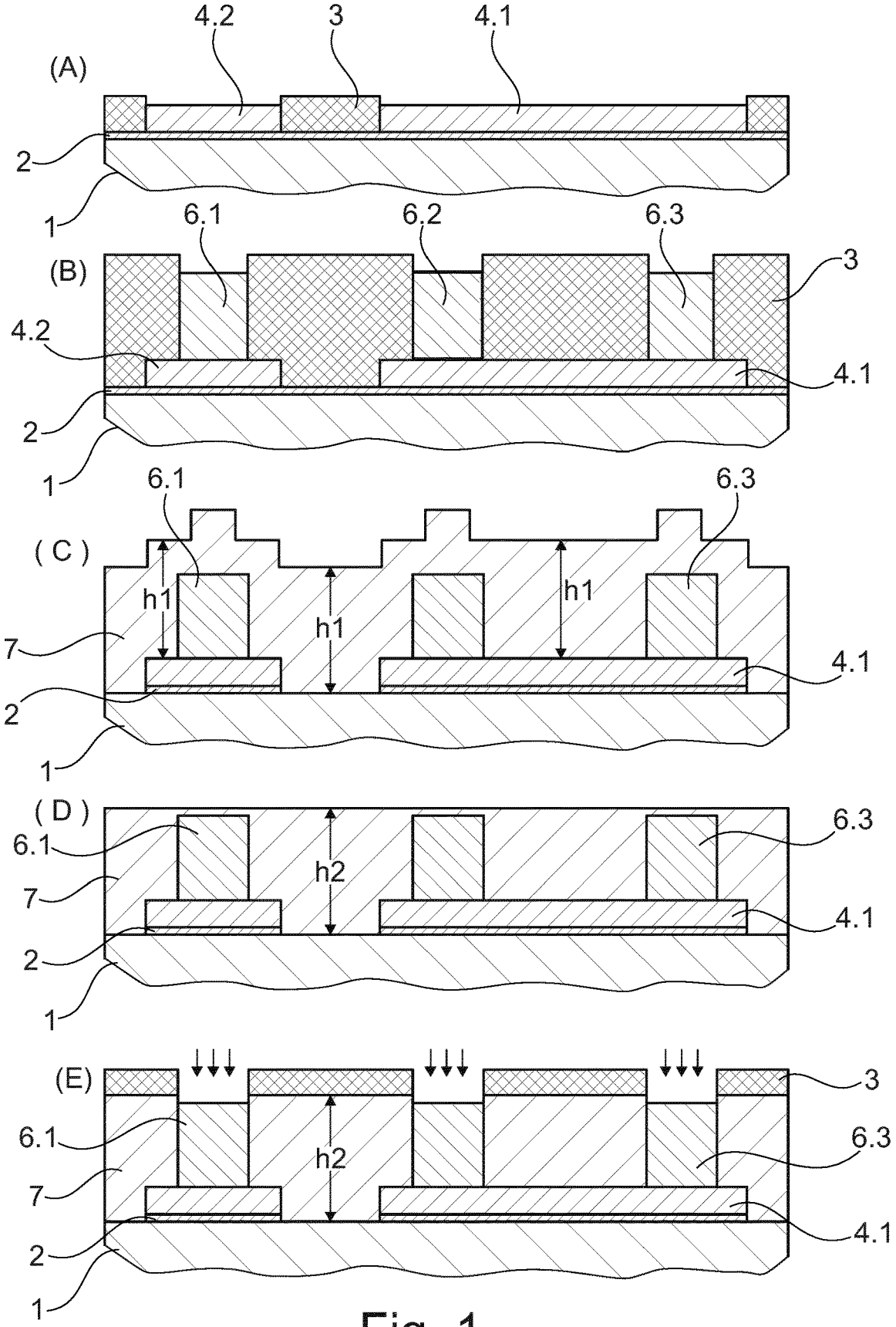

that the at least one contacting element (6) is connected to the at least one electric conductor element (4) in an electrically conductive manner, (d) removing the starting layer (2) in regions in which no electric conductor element (4) has been applied, (e) applying an insulation layer (7) that at least partially covers the at least one electric conductor element (4) and the at least one contacting element (6), (f) planarizing the insulation layer (7) and exposing the at least one contacting element (6), and (g) applying at least one additional electric conductor (14) element by means of electrochemical deposition and/or a lift-off method, such that the at least one additional electric conductor element (14) is connected to the at least one contacting element (6) in an electrically conductive manner.

11 Claims, 4 Drawing Sheets

(56) References Cited

OTHER PUBLICATIONS

Bautista-Salvador, "Integrated Electromagnets and Radiofrequency Spectroscopy in a Planar Paul Trap", Dissertation, Universitaet Ulm, 2015.
Hellwig et al, "Fabrication of a planar micro Penning trap and numerical investigations of versatile ion positioning protocols", New Journal of Physics, 12 (2010) 065019.
Hong et al, "Experimental Methods for Trapping Ions Using Microfabricated Surface Ion Traps", Journal of Visualized Experiments, Aug. 2017, 126, e56060.

* cited by examiner

METHOD FOR PRODUCING AN ATOM TRAP, AND ATOM TRAP

The invention relates to a method for producing an atom trap as well as an atom trap produced according to said method.

Atom traps are devices that store neutral atoms and/or ions. In the case of ions, these are commonly trapped using an electric field and in the case of neutral atoms, using a magnetic field, as well as by cooling the ions or neutral atoms to be trapped in the atom trap. Cooling can be achieved, for instance, by way of the laser cooling method.

The term storing is understood particularly to mean that the neutral atoms or ions do not leave the atom trap or the respective field for a period of at least one second, preferably at least one minute, even more preferably at least 10 minutes.

Within the scope of this description, an atom trap is understood to mean a device for generating such an electric and/or magnetic field, by means of which the atoms or ions can be stored. In other words, any necessary cooling devices are not part of the claimed invention.

To trap or store the neutral atoms or ions, inhomogeneous magnetic fields or inhomogeneous electric fields are preferably used. It is possible, for instance by means of photoionization, to first transform neutral atoms into ions and then to store these in electric fields.

The ions may refer in particular to monatomic ions, but also to polyatomic ions, i.e. molecular ions.

Atom traps are used, for instance, in quantum information processing, for example as quantum sensors or for quantum sensors. They may be formed of microtechnical structures. It is possible, for example, and especially advantageous to form multilayer atom traps. They comprise several layers arranged on top of one another, which in turn each have electric conductor structures. In this case, the individual layers must be reproducible and it must be possible to produce them with few deviations, since irregularities propagate and add up when the layers are applied to each other. In the prior art, this often leads to difficulties in production.

Furthermore, the different conductor structures in the individual layers should be conductively connected to one another, which is difficult to achieve in the prior art, especially in a process with the necessary reproducibility and freedom from irregularities and the required layer thicknesses and material combinations.

In addition, atom traps are particularly susceptible to electric fields of interference. In particular, atomic traps may require an electric and/or magnetic field that is as well-defined as possible in terms of time and especially constant for storing atoms and/or ions.

The generation of the electric fields requires the application of especially high voltages, from several Volts up to several hundred Volts, to the conductor structures without incurring any damage to the structures. The resulting, in particular starkly inhomogeneous, electromagnetic fields serve to entrap the atoms in the atom trap as strongly as possible, so that this entrapment is considerably stronger than any fields of interference that may occur.

Furthermore, fields of interference can be minimized, for example, by realizing large aspect ratios, such that charges accumulated on exposed dielectrics below the conductor layer generate the smallest possible electric fields at the point above the structure where the atoms are stored. An aspect ratio is understood particularly to mean the height of the electric conductor structures in relation to the gaps between the same conductor elements.

The article "Fabrication of a planar micro Penning trap and numerical investigations of versatile ion positioning protocols" by Hellwig et al, New I Phys. 12 (2010), p. 065019-1-065019-10 describes the production of a Penning trap with a honeycombed trap structure. To this end, gold is electrochemically deposited during a shaping step. The production of structures, by means of which complex magnetic fields can be generated without the occurrence of any fields of interference, is almost impossible with such a method.

The article entitled "Experimental methods for trapping ions using microfabricated surface ion traps" by Hong et al, J. Vis. Exp. 126 (2017), S. e56060-1-e56060-14 describes a Paul trap that is produced via the successive application of conductor paths. The conductor paths are produced by spin-coating photoresist, structuring and removing. The method described in said article renders the production of structures that conduct large electrical currents with sufficient electrical resistance almost impossible.

The dissertation entitled "Integrated electromagnets and radiofrequency spectroscopy in a planar Paul trap" by Bautista-Salvador, Chapter 3; Dissertation, University of Ulm, 2015; DOI: 10.18725/OPARU-3352 describes a Paul trap in which layers of gold are electrochemically applied. Electrodes extending in different directions in different planes are not included in the dissertation.

The article entitled "Implementation of a symmetric surface-elektrode ion trap with field compensation using a modulated Raman effect" by Allcock et al, New J. Phys. 12 (2010), p. 053026-1-053026-18 also describes a Paul trap in which the electrodes have been produced by electro-chemical deposition. This publication does not discuss the application of several layers either.

The task of the present invention is to improve the production of atom traps.

The invention solves the problem by means of a method with the steps: (a) applying an electrically conductive starting layer onto a substrate, (b) applying at least one electric conductor element to the starting layer by means of electrochemical deposition and/or a lift-off method, (c) applying at least one contacting element by means of electro-chemical deposition and/or a lift-off method, such that the at least one contacting element is connected to the at least one electric conductor element in an electrically conductive manner, (d) removing the starting layer in regions in which no electric conductor element was applied, (e) applying an insulation layer that at least partially covers the at least one electric conductor element and the at least one contacting element, (f) planarizing the insulation layer and exposing the at least one contacting element, and (g) applying at least one additional electric conductor element by means of electrochemical deposition and/or a lift-off method, such that the at least one additional electric conductor element is connected to the at least one contacting element in an electrically conductive manner.

The invention also solves the problem by way of an atom trap, produced according to the method according to the invention and comprising at least one electric conductor element applied by electro-chemical deposition and/or a lift-off method, and at least one contacting element applied by electro-chemical deposition and/or a lift-off method, wherein the at least one electric conductor element and the at least one contacting element have a layer thickness of at least 1 μm and an aspect ratio of at least 1.

The substrate is, for example, a wafer composed of silicon dioxide or corundum. The substrate may also be formed of a body composed of electrically conductive material, such as silicon, which features an insulating, i.e. electronically non-conductive, coating, for instance made of silicon dioxide or silicon nitride.

In a first step, an electrically conductive starting layer is applied to this substrate, preferably composed of an alloy or a metal, such as copper, silver or nickel. Preferably, the starting layer is made of gold or an alloy containing gold.

Gold is seldom used in semiconductor technology as it has several disadvantageous properties. For example, it may contaminate laboratories that have been designed as clean rooms, such that, for instance, in laboratories in which gold is handled, CMOS semiconductors can no longer be produced. Furthermore, gold is very soft and particularly difficult to mechanically polish; it is also expensive.

Nevertheless, gold is preferably used in the present invention, since it is not very reactive, for example, and exhibits only a slight tendency to adhere to adsorbates.

In a further step, at least one electric conductor element is applied to the starting layer by means of electro-chemical deposition and/or a lift-off method. Here, the electrically conductive starting layer acts in particular as a counter-electrode for the electro-chemical deposition, which is also described as galvanic deposition.

In this case, a structure is applied to the starting layer, preferably by means of photolithography. The photoresist may be, for example, a positive or negative resist, wherein the at least one electric conductor element is applied by means of electro-chemical deposition in the regions in which the starting layer is not covered by photoresist.

Finally, another layer of photoresist is applied using photolithography, wherein the photoresist applied in the previous step has preferably been removed prior to doing so.

This structure of photoresist, which can be positive or negative resist, determines the position of the later contacting elements. Said elements are formed using electro-chemical deposition in the regions that contain no photoresist.

In particular, these regions are situated above the conductor elements applied to the starting layer, such that the contacting elements are connected to them in an electrically conductive manner.

The starting layer is subsequently removed in regions in which no electric conductor element has been applied. Specifically, the previously applied photoresist is removed beforehand and the starting layer removed, for example, by wet or dry etching.

The substrate is preferably exposed in all regions that do not contain an electric conductor element. Alternatively, only narrow regions of the starting layer are removed, so that the electric conductor elements that are spaced apart from each other are no longer connected in an electronically conductive manner via the starting layer and regions remain where the starting layer has not been removed.

Alternatively, the removal of the starting layer may occur before the application of the at least one contacting element.

The insulation layer is preferably composed of a dielectric or a mix of different dielectrics, such as a polyimide, a silicone or a polymer made of or with benzocyclobutene (BCB).

The insulation layer can be applied, for instance, by means of spin-coating. This is especially preferably if the dielectric that forms the insulation layer is a polyimide or a polymer made of or with BCB.

The insulation layer is applied in such a way that it at least partially, but preferably fully, covers the at least one conductor element and the at least one contacting element. The insulation layer preferably fully encloses the at least one conductor element and the at least one contacting above the substrate and/or the starting layer.

The invention also solves the problem by way of a method with the steps: (a) applying an electrically conductive starting layer onto a substrate, (b) applying at least one electric conductor element to the starting layer by means of electro-chemical deposition and/or a lift-off method, (c) removing the starting layer in regions in which no electric conductor element was applied, (d) applying an insulation layer that at least partially, but especially fully, covers the at least one electric conductor element, (e) removing the insulation layer in predetermined regions above the at least one electric conductor element, such that the at least one electric conductor element is partially exposed, (f) applying through-contacting elements by means of electro-chemical deposition and/or a lift-off method in the regions in which the at least one electric conductor element is exposed, and (g) applying at least one additional electric conductor element by means of electro-chemical deposition and/or a lift-off method, such that the at least one additional electric conductor element is connected to the at least one contacting element in an electrically conductive manner. As an option, prior to the execution of step (e), namely the removal of the insulation layer in a predetermined region above the at least one electric conductor element, such that the at least one conductor element is exposed, a planarization of the insulation layer, in particular via chemical-mechanical polishing, may be carried out. Before the application of through-contacting elements in step (f), a starting layer can be applied, which is covered with a photoresist, in particular at points where no contacting elements are provided. All statements made with regard to the subject of the main claim also apply mutatis mutandis to this configuration of the method according to the invention.

As a result of the different structures applied thus far, which in particular have different heights, the insulation layer does not have a smooth surface; rather, it features an uneven surface structure. In particular, this corresponds to the structures beneath it, such that the insulation layer exhibits an especially great height above the substrate in the regions containing electric conductor elements and/or contacting elements than in regions where the insulation layer only covers the substrate. Specifically, the insulation layer features a structure that corresponds to the underlying structure of substrate, the remaining starting layer, the electric conductor elements and the contacting elements.

Following application, the insulation layer is planarized and the at least one contacting element exposed. Planarization means particularly that the surface of the insulation layer is smoothed, so that it is as smooth as possible and preferably extends parallel to the surface of the substrate. The planarization of the insulation layer is preferably achieved by chemical-mechanical polishing.

The exposure of the at least one contacting element occurs especially in one of the two alternative methods described in the following.

Preferably, so much material of the insulation layer is removed during planarization that the at least one contacting element is still covered by the insulation layer, but the layer thickness of the material of the insulation layer that covers the at least one contacting element is as low as possible. This layer thickness is preferably less than 500 nm, but especially preferably less than 250 nm.

Preferably, to expose the at least one contacting element, photoresist is first applied to the planarized insulation layer.

This photoresist can be a positive or negative resist. The photoresist is preferably applied to the insulation layer in such a way that it is not found in the regions below which the at least one contacting element is situated. It is especially preferable if regions below which the at least one contacting element is situated remain exclusively free from photoresist.

The dielectric, i.e. the insulation layer, above the at least one contacting element can be subsequently removed, for instance by means of wet or dry etching, thereby exposing said contacting element.

The resulting difference in height between the insulation layer and the at least one contacting element in relation to the substrate is preferably at most 500 nm, but especially preferably at most 250 nm.

Prior to applying the at least one additional electric conductor element, the previously applied photoresist is preferably removed.

It is especially preferable if, prior to the application of the at least one additional electric conductor element, an additional electrically conductive starting layer is applied, which is to be found specifically on both the insulation layer and the previously exposed contacting elements.

The at least one additional electric conductor element is applied in such a way that it is connected to the at least one contacting element in an electrically conductive manner. Therefore, according to the invention, each additional electric conductor element is connected to at least one underlying contacting element such that it is electrically conductive. However, it is also possible for some or all electric conductor elements to be connected to more than one contacting element.

This connection is preferably achieved via the applied additional starting layer, such that the at least one additional electric conductor element and the at least one contacting element are not directly connected to each other, but instead are connected in an electrically conductive manner via the additional starting layer.

Preferably, the electric conductor elements and/or the contacting elements are made of gold or copper, or an alloy containing gold and/or copper.

Despite the specified general disadvantages of using gold in microtechnology, it is advantageous for the atom trap according to the invention or the method according to the invention for producing an atom trap. Gold has a high electrical conductivity. Furthermore, it is not very reactive and exhibits only a slight tendency to adhere to adsorbates. These may cause the emergence of fields of interference, which renders difficult or even prevents the entrapment of the atoms and/ions.

The exposure of the at least one contacting element is preferably achieved by the planarization of the insulation layer in step (f).

This means that the insulation layer is planarized until it no longer covers the at least one contacting element. In particular, it is possible in this case that, as a result of planarization, material of the at least one contacting element is removed, in addition to the material of the insulation layer.

Specifically, if the planarization of the insulation layer is achieved by means of chemical-mechanical polishing, this method, when deployed for contacting elements made of soft material, such as pure gold, can cause a smearing of the contacting element as soon as the polishing pad reaches it.

This method is therefore preferably used with sufficiently hard materials for the contacting element, such as copper or nickel or alloys, especially gold alloys, with a sufficient hardness.

The method preferably comprises a step (h), which is conducted particularly after step (g) of the main claim, namely the application at least one additional electric conductor element by means of electro-chemical deposition and/or a lift-off method, such that the at least one additional electric conductor element is connected to the at least one contacting element in an electrically conductive manner. The step (h) comprises the removal of the insulation layer in regions in which no additional electric conductor element has been applied, such that gaps form.

If an additional electrically conductive starting layer has been applied to the insulation layer and the through-contacting elements, it is first removed in the regions in which no additional electric conductor element has been applied. This can be done in the same process step that also comprises the removal of the insulation layer in these regions. In other words, this results in the exposure of underlying layers. The insulation layer is removed, for instance, until an underlying electric conductor element or the substrate is reached.

Here, a gap is understood particularly to mean a material-free space that is restricted laterally by applied structures in at least two spatial directions parallel to the substrate. For instance, it may refer to a completely, i.e. enclosed laterally in all four spatial directions parallel to the substrate, material-free space. However, it may also refer to a duct that is only restricted on two sides and traverses the atom trap from one side of the substrate to another side of the substrate parallel to the substrate.

In addition, it is possible that such a gap forms a duct that does not completely traverse the atom trap. In other words, this duct is surrounded by structures on three sides.

Preferably, the gaps have an aspect ratio of at least 1. Aspect ratio is understood to mean the height or depth of an object in relation to its smallest lateral extension.

In the present case, the aspect ratio therefore refers to the ratio of the spatial depth of a gap to its smallest width, especially parallel to the substrate.

The depth of a gap is understood particularly to mean a distance perpendicular to the substrate which extends from the lowest edge of a structural element laterally bordering the gap to the bottom of the gap, which extends in particular parallel to this edge, and is formed, for example, by an electric conductor element or the substrate.

The greater the aspect ratio and thus the greater the depth of the gap in relation to its smallest width, the more advantageous it is for an atom trap. In other words, it is advantageous if the gaps are as narrow as possible. Therefore, they preferably have an aspect ratio of at least 3, more preferably at least 4, even more preferably at least 5. The method preferably comprises the step: repeating steps (c) to (g) or (c) to (h), thereby obtaining a multilayer atom trap. In other words, the production method according to this embodiment of the atom trap is not complete following the execution of steps (a) to (g) or (a) to (h). Rather, some of the steps are repeated at least once.

Preferably, additional contacting elements are applied by means of electro-chemical deposition and/or a lift-off method, wherein said contacting elements are connected to the electric conductor elements applied in step (g) in an electrically conductive manner.

If a starting layer has been applied and not already removed beforehand, for example to produce gaps, it is subsequently removed. If there is no starting layer in regions where no electric conductor element has been applied, step (d) need not be conducted.

The subsequent steps are conducted in the same way as the statements already made.

Preferably, the steps (c) to (g) or (c) to (h) are carried out at least once, preferably at least five times, even more preferably at least ten times, and especially preferably at least twenty times. In other words, a multilayer structure of conductor elements emerges that are connected to one another via through-contacting elements in a direction that is perpendicular to the substrate.

Specifically, no new material is applied in regions where gaps have previously been created. In other words, the aspect ratio of the gaps increases with every additional applied layer, since the surrounding structural elements become higher.

The feature that the aspect ratio is preferably at least 1, more preferably at least 3, even more preferably at least 4 and especially preferably at least 5, is understood particularly to mean the aspect ratio of the resulting gaps, i.e. in the complete, preferably multilayer, atom trap.

In other words, it is possible, but not essential, for the specified aspect ratios to be achieved already during the formation of the gaps by removing material. In fact, it is sufficient if the required aspect ratio is achieved in the finished atomic trap, e.g. after repeating steps (c) to (g) or (c) to (h) several times.

The greatest possible aspect ratio is advantageous, since potentially interfering substances or adsorbates are highly unlikely to be able to penetrate these gaps and be deposited there. Such interfering substances or adsorbates may cause, for instance, the formation of electric fields of interference which render difficult or even prevent the entrapment of neutral atoms or ions in the atom trap. The greatest possible aspect ratio is also advantageous because dielectrics may carry surface charges in the lower region of the gap. When these surface charges are hidden so deep in the gaps, they generate only small electric fields at the point of the stored atoms and thus interfere with them less.

Preferably, the electric conductor elements are applied with a layer thickness of at least 1 μm and/or the insulation layer and/or the at least one contacting element is applied with a layer thickness of at least 1 μm.

The greatest possible thickness of the electric conductor elements is diametrically opposed to the attempts at further miniaturisation that are common in microtechnology. However, in the case of atom traps, the thickest possible conductor elements are advantageous, since they are able to conduct greater currents. Specifically, such large currents are advantageous or even necessary to trap neutral atoms and for the magnetic field required to do so.

Preferably, the contacting elements also have a layer thickness of at least 1 μm.

A layer thickness of at least 1 μm can be achieved, for example, by way of electro-chemical deposition, a method that is otherwise disadvantageous in microtechnology.

This often has the disadvantage that it generates elements which are too thick and too irregular for many microtechnical applications.

Preferably, the insulation layer also has a layer thickness of at least 1 μm. The thickness of the insulation layer preferably corresponds to the layer thickness of the contacting elements. It is preferably as great or greater.

The layer thickness of the electric conductor elements and/or the contacting elements and/or the insulation layer is preferably more than 3 μm, preferably more than 5 μm and especially preferably more than 10 μm.

Preferably, the conductor elements and/or the contacting elements have an aspect ratio of at least 1. In other words, the spatial extension in the direction perpendicular to the substrate is at least as great as the smallest lateral extension, which in particular extends parallel to the substrate.

It is especially preferable if the conductor elements and/or the contacting elements have an aspect ratio of at least 3, preferably at least 4, but especially preferably at least 5.

The substrate preferably features a recess for passing an atomic beam or such a recess is introduced into the substrate. Such a recess may be a duct, for example, which completely traverses the substrate from a lower side to an upper side and is thus surrounded by said substrate in all four spatial directions parallel to it. However, it is also possible that the recess is only surrounded by the substrate in three spatial directions.

An atomic beam can be guided through such a recess, wherein atoms or ions from said atomic beam can be trapped by the atom trap. According to the invention, the atom beam may also be an ion beam.

Such a beam can be generated, for instance, by heating a metal wire, such as a beryllium wire, at specific points. In addition, it is possible to produce ions at specific points of an atomic beam by means of photoionization and then to trap and store them.

Preferably, the substrate comprises at least one substrate through-contacting element or it is introduced into the substrate. The substrate has an upper side and a lower side, wherein the method according to the invention is conducted in particular on the upper side of the substrate. The at least one electrically conductive substrate through-contacting element preferably extends from the upper side to the lower side of the substrate.

On the upper side of the substrate, the electric conductor elements are preferably applied in such a way that they are connected to this at least one substrate through-contacting element in an electrically conductive manner. This enables the connection of the source of electrical current necessary for supplying an electrical current to the electrical conductor elements to the back of the substrate. The electric current can then be introduced into the at least one electric conductor via the substrate through-contacting element. It is also possible that only a potential, especially static voltages, is applied to the electric conductor elements. In other words, a supply of an electrical current to the at least one conductor element is possible, but not essential.

An atom trap according to the invention is characterized in that it features conductor elements and contacting elements with a layer thickness of at least 1 μm. In particular, this is rendered possible by electro-chemical deposition during production. Other production methods, such as sputtering, result in considerably lower layer thicknesses and are therefore technically impractical.

A high layer thickness is advantageous because especially traps for neutral atoms must be able to carry high currents to provide field configurations with a stable and very large spatial inhomogeneity to store the atoms. Furthermore, the conductor elements and the contacting elements have an aspect ratio of at least 1, so that especially narrow structures are formed. Preferably, any gaps formed also have an aspect ratio of at least 1. This ensures that charges accumulated on dielectric layers in the wall region of the gaps below conductor elements cause the smallest possible fields of interference at the location of the atoms. The atom trap according to the invention is characterized especially in that its structure can be scaled particularly easily. In other words, almost any number of layers, in particular at least 10 layers, can be formed without irregularities propagating in such a way that a functional structure is no longer given.

In the following, embodiments of the invention will be explained by way of the attached figures. They show FIG. 1 the first part of a visualization of the sequence of a method according to the invention for producing an atom trap, FIG. 2 the second part of a visualization of the sequence of a production method according to the invention, FIG. 3 a schematic representation of an atom trap according to the invention, FIG. 4 a schematic representation of a further embodiment of an atom trap according to the invention with a recess for passing an atomic beam and substrate through-contacting elements, and FIG. 5 a section of a schematic sectional representation of a multilayer atom trap according to the invention.

Figure 2:
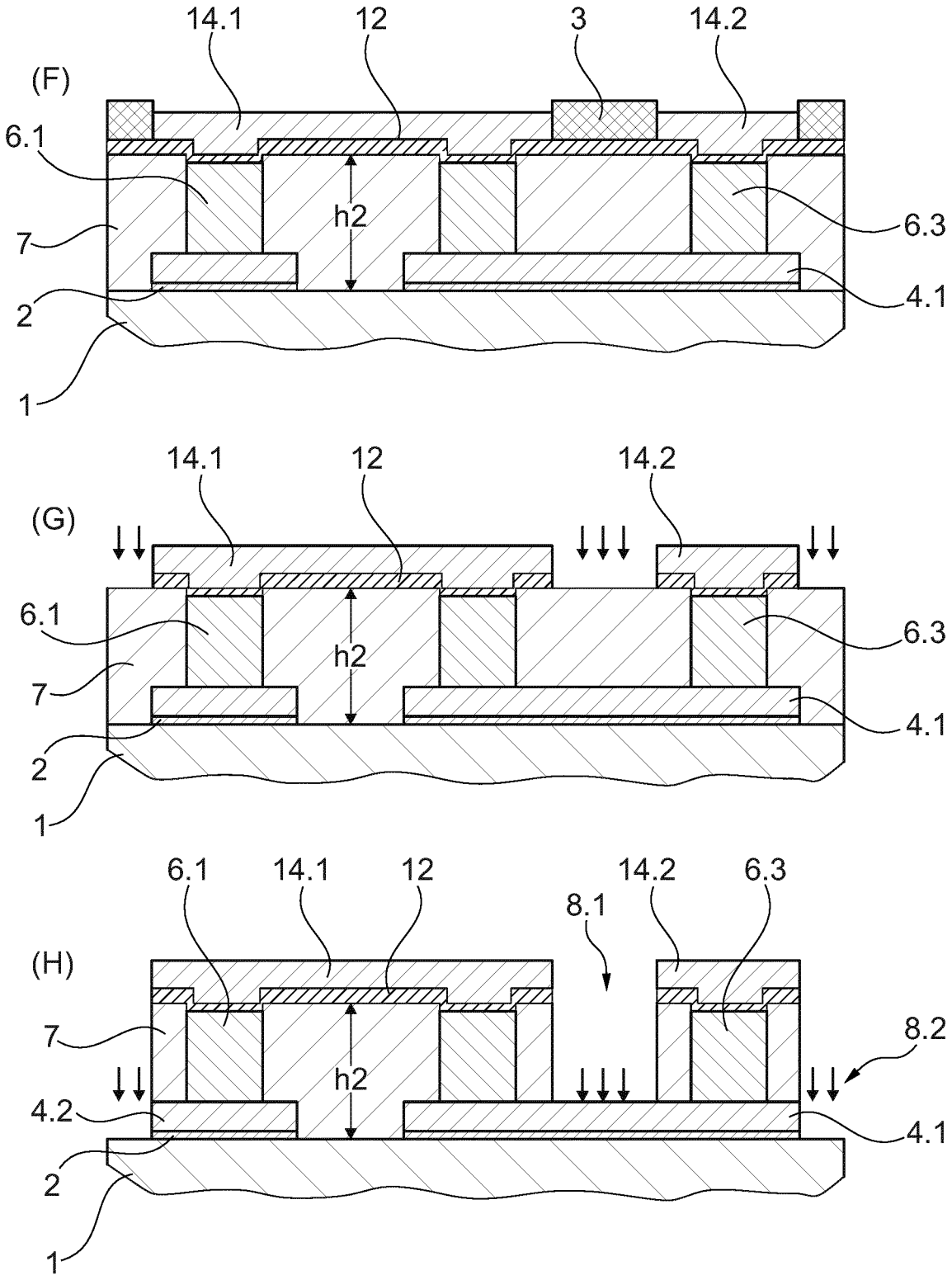

FIGS. 1 and 2 feature a schematic depiction of a production method according to the invention.

In FIG. 1, the starting layer 2, which is metallic in this case, has already been applied to the substrate 1, in particular across the entire surface and by means of vapor deposition. Photoresist 3 is then applied to said starting layer, especially by means of spincoating or spray-coating.

The photoresist is preferably either a negative or positive resist. In the case of a positive resist, a mask is used which is translucent at the points where the subsequent electric conductor elements 4 (4.1, 4.2) are to be arranged. Exposure makes the positive resist liquid or soluble in the exposed areas so that it can be removed in these regions. The photoresist subsequently remains only in the regions in which electric conductor elements 4 are not to be applied. It thus acts as a mould or template for the application of the at least one electric conductor element 4.

In the case of a negative resist, the regions of the mask that are translucent are those in which the subsequent electric conductor elements 4 are not to be applied. In these regions, the photoresist 3 hardens when exposed. In the non-exposed regions, it can therefore be removed, resulting again in a mould or template for the application of the at least one electric conductor element 4.

In FIG. 1, two electric conductor elements 4.1 and 4.2 have been applied. They are spatially separated from each other and are initially connected to one another in an electrically conductive manner via the starting layer 2.

During the galvanic deposition of the electric conductor elements 4.1 and 4.2, the starting layer 2 acts as a counter-electrode.

Additional photoresist 3 is subsequently applied, which acts as a mould or template for the contacting elements 6. The previously applied photoresist can be removed beforehand. However, it is also possible to apply the additional photoresist to the existing photoresist, i.e. the latter is not removed beforehand.

The contacting elements 6, in the present case the three contacting element 6.1 to 6.3, are subsequently applied by way of electrolytic deposition in the regions that contain no photoresist 3.

The photoresist 3 is then removed, especially completely removed. This may be achieved using a suitable solvent, such as acetone.

In addition, the starting layer 2 is removed in the areas in which no conductor elements 4 have been applied to it. It is preferably possible to remove the starting layer 2 and the photoresist 3 in a single process step.

Alternatively, the starting layer 2 can be removed prior to applying the contacting elements 6.

An insulation layer 7 is subsequently applied. In the present case, this is composed of a polyimide and is applied by means of spin-coating. Preferably, the insulation layer completely covers the previously applied structures. Due to the different heights of the individual structures in relation to the substrate 1, the insulation layer exhibits a structure that corresponds especially to the structures lying beneath it. The height of the insulation layer, i.e. the distance between surface and the underlying structure, is preferably almost constant. This is indicated as h1 in FIG. 1. However, the absolute height of the insulation layer above the substrate varies and leads to the described corresponding structure.

To remove this interfering structure of the insulation layer, the insulation layer 7 is subsequently planarized. It is preferably planarized by means of chemical-mechanical polishing, such that it preferably then has a constant height h2 above the substrate 1. Consequently, material of the insulation layer is removed.

In the embodiment shown, the insulation layer 7 is only planarized so far, i.e. only so much material is removed, that the contacting elements 6.1 to 6.3 are still covered by the insulation layer 7. In particular, the height of this layer covering the contacting elements 6.1 to 6.3 is as low as possible. It is preferably less then 250 nm.

Photoresist 3 is subsequently reapplied, leaving out the regions below which the contacting elements 6.1 to 6.3 can be found. In these omitted regions, the insulation layer is removed, for example by etching or a suitable solvent. Preferably, a removal method is used that does not affect the contacting elements 6.

In the regions of the insulation layer 7 covered by the photoresist 3, the height is still the height h2, which is in particular constant.

An additional electrically conductive starting layer 12 is then applied to the insulation layer 7 and the exposed contacting elements 6.1 to 6.3.

Photoresist 3 is subsequently reapplied to said starting layer, which acts as a mould or template for the additional electric conductor elements 14.1 and 14.2. These are applied to the additional starting layer 12 by means of electro-chemical deposition.

The photoresist is subsequently removed. The additional starting layer 12 is also removed in the regions in which no additional electric conductor element 14 has been applied. This is done in two separate steps or preferably in one process step.

In the regions where the photoresist 3 and the starting layer 2 have been removed, the insulation layer 7 is now exposed. This insulation layer is also subsequently removed, for example through etching, thereby producing gaps 8. These gaps are restricted at the bottom by the electric conductor elements 4 and/or the substrate. In the present case, the gap 8.1 is restricted by the electric conductor element 4.1. The gap 8.2 indicated at the edge, however, is restricted by the substrate 1.

Additional contacting elements 16 can be subsequently applied to the conductor elements 14 to obtain a multilayer atom trap. The process steps outlined above can be repeated several times.

It is also possible to conduct the depicted method only in certain regions of the substrate 1. Furthermore, it is also possible to conduct the method in several different regions of the same substrate 1.

Figure 3:
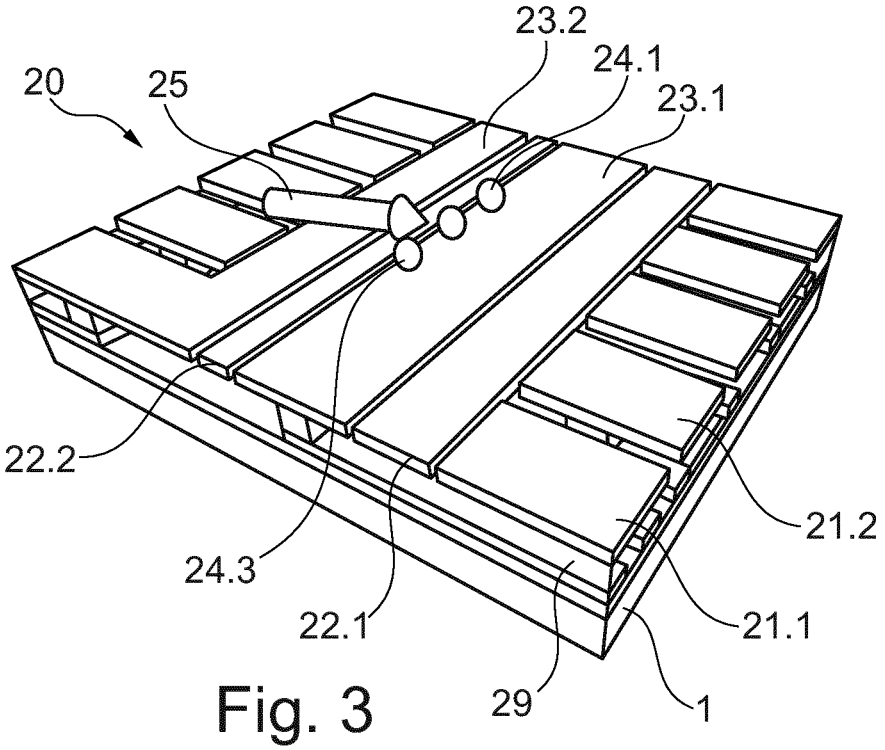

FIG. 3 shows such an atom trap 20 according to the invention. In it, several multilayer and spatially separated conductor structures 21 to 23 are schematically depicted. They have been applied to the substrate according to the method outlined in FIGS. 1 and 2. The conductor structures 21 to 23 are preferably not conductively connected to one another and they each comprise their own electrical connection 29 for the purposes of electrical current supply.

The conductor structures 21 to 23 serve to generate an electric field, especially an inhomogeneous electric field, above the atom trap. In the present case, ions 24.1 to 24.3 are trapped and stored in said field. These ions were previously generated from neutral atoms by means of photoionization. A laser beam 25 is deployed for photoionization.

The multilayer conductor structures 21.*i* (where i=1, 2) are connected to a DC voltage. The conductor structures 22.1 and 22.3 are connected to an AC voltage and the conductor structures 23.1 and 23.2 are grounded. However, it is also possible for the conductor structures 23 to be connected to a DC voltage that is different to 0.

Figure 4:
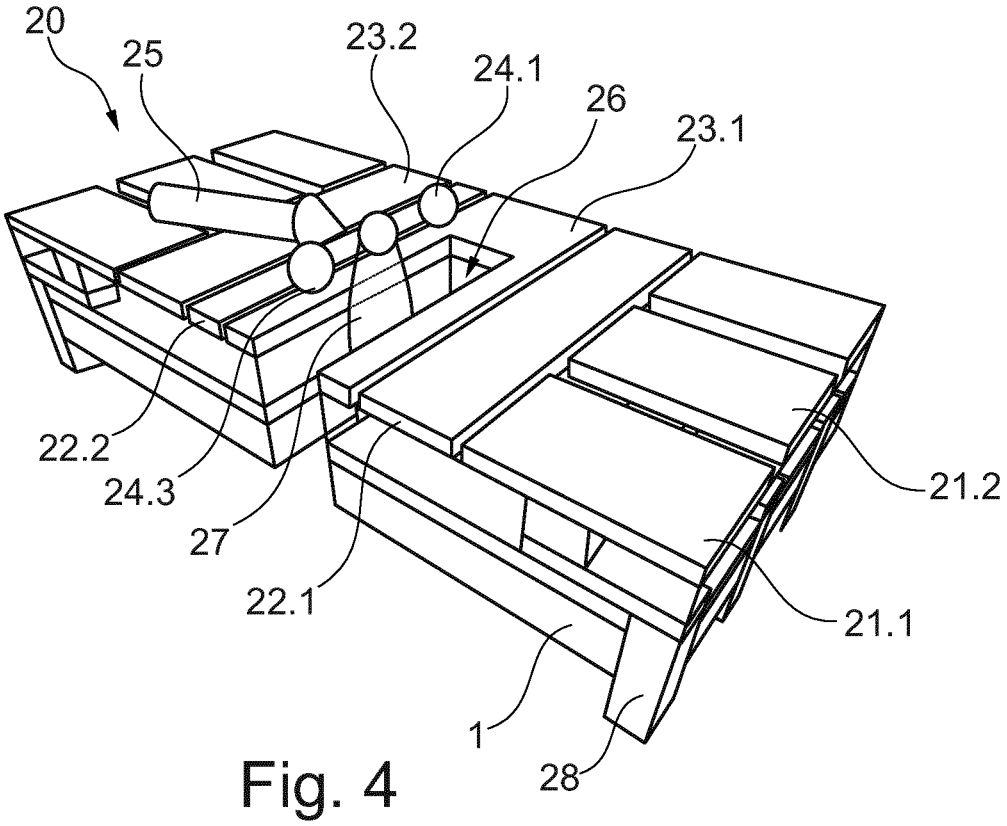

FIG. 4 schematically depicts a further embodiment of an atom trap 20 according to the invention. This atom trap also features multilayer conductor structures 21 to 23, wherein a recess 26 in the form of a duct has also been introduced in the substrate 1. An atomic beam 27 is guided through this recess.

The atomic beam 27 can be generated by heating a metal wire, for instance by heating a beryllium wire at specific points to over 1000 K.

In the present case, atoms of the atomic beam are transformed into ions 24.1 to 24.3 by photoionization, which are stored in the electric field generated by the multilayer conductor structures 21 to 23.

The substrate also features substrate through-contacting elements 28, via which the multilayer conductor structures 21 to 23 are supplied with an electrical current. Preferably, at least one substrate through-contracting element 28 is assigned to each multilayer conductor structure 21 to 23. By means of the substrate through-contacting elements 28, an electrical current can be supplied very easily from the back of the substrate 1.

Figure 5:
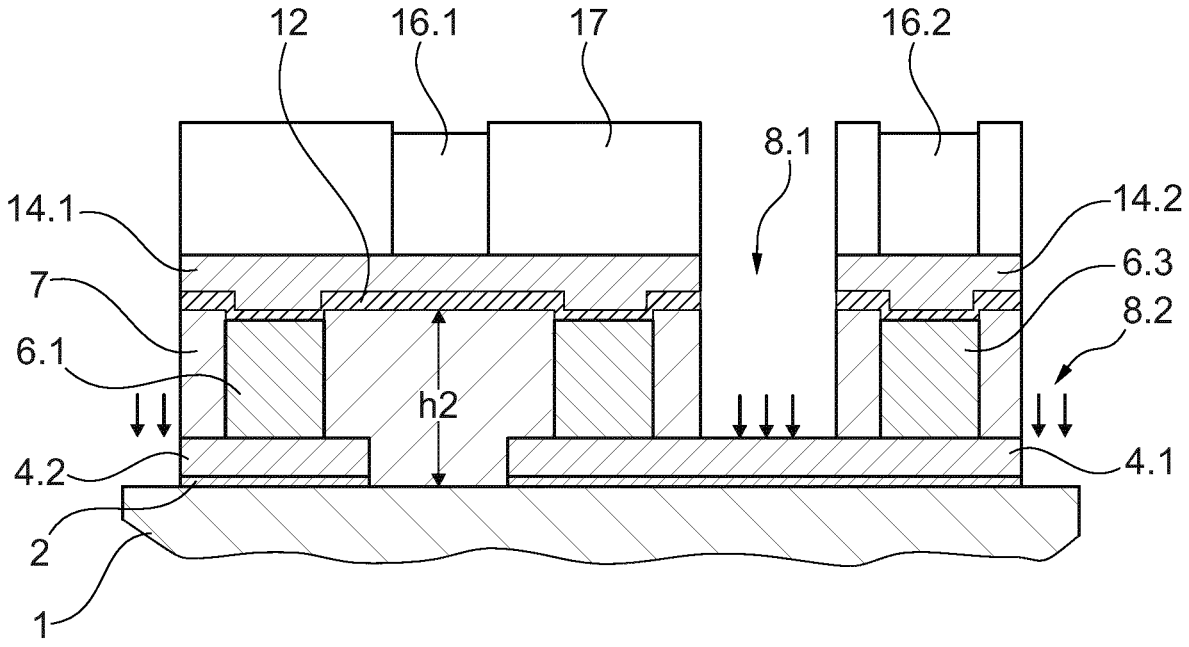

FIG. 5 depicts an exemplary sectional representation of a multilayer atom trap. The sectional representation corresponds to the atom trap from the production method depicted in FIGS. 1 and 2. Additional contacting elements 16.1 and 16.2 have been applied by means of electrochemical deposition to the most recently applied conductor elements 14.1 and 14.2. They are preferably identical in dimension to the contacting elements 6.1 to 6.3. In the regions where no additional contacting element 16 has been applied to the additional electric conductor elements 14.1 and 14.2, an additional insulation layer 17 has been applied via spin-coating. In FIG. 5, the contacting elements are exposed and an additional starting layer, not shown, follows, which is supported on the additional contacting elements 16.1 and 16.2 and the additional insulation layer 17.

FIG. 5 shows that the aspect ratio, i.e. the ratio of the width to the height of the gaps 8.1 and 8.2 increases with the application of additional layers. The gaps 8.1 and 8.2 in FIG. 5 therefore exhibit a greater height than in FIG. 2, which leads to a greater aspect ratio if the width remains the same.

REFERENCE LIST

1 substrate
2 starting layer
3 photoresist
4 electric conductor element
6 contacting element
7 insulation layer
8 gap
12 additional starting layer
14 additional electric conductor element
16 additional contacting element
17 additional insulation layer
20 atom trap
21 multilayer conductor structure, connected to a DC voltage
22 multilayer conductor structure, connected to an AC voltage
23 multilayer conductor structure, grounded
24 ion
25 laser beam
26 recess
27 atomic beam
28 substrate through-contacting element
29 electrical connection
h height

The invention claimed is:

1. A method for producing an atom trap comprising the steps:

(a) applying an electrically conductive starting layer onto a substrate, (b) applying at least one electric conductor element to the starting layer by means of electro-chemical deposition and/or a lift-off method, (c) applying at least one contacting element by means of electro-chemical deposition and/or a lift-off method, such that the at least one contacting element is connected to the at least one electric conductor element in an electrically conductive manner, (d) removing the starting layer in regions in which no electric conductor element has been applied, (e) applying an insulation layer that at least partially covers the at least one electric conductor element and the at least one contacting element, (f) planarizing the insulation layer and exposing the at least one contacting element, and (g) applying at least one additional electric conductor element by means of electro-chemical deposition and/or a lift-off method, such that the at least one additional electric conductor element is connected to the at least one contacting element in an electrically conductive manner.

2. A method for producing an atom trap comprising the steps:

(a) applying an electrically conductive starting layer onto a substrate, (b) applying at least one electric conductor element to the starting layer by means of electro-chemical deposition and/or a lift-off method, (c) removing the starting layer in regions in which no electric conductor element has been applied, (d) applying an insulation layer that at least partially, but especially fully, covers the at least one electric conductor element, (e) removing the insulation layer in predetermined regions above the at least one electric conductor element, such that the at least one electric conductor element is partially exposed, (f) applying contacting elements by means of electro-chemical deposition and/or a lift-off method in the regions in which the at least one electric conductor element is exposed, and (g) applying at least one additional electric conductor element by means of electro-chemical deposition and/or a lift-off method, such that the at least one additional electric conductor element is connected to the at least one contacting element in an electrically conductive manner.

3. The method according to claim 1, wherein the electric conductor elements and/or the contacting elements are composed of gold or copper, or an alloy containing gold and/or copper.

4. The method according to claim 1, further comprising: exposing the at least one contacting element by planarizing the insulation layer in step (f).

5. The method according to claim 1, further comprising: (h) removing the starting layer in regions in which no additional electric conductor element has been applied, such that gaps form.

6. The method according to claim 4 wherein the gaps have an aspect ratio of at least 1.

7. The method according to claim 1, further comprising: repeating steps (c) to (g) or (c) to (h), thereby obtaining a multilayer atom trap.

8. The method according to claim 1, wherein the electric conductor elements are applied with a layer thickness of at least 1 μm and/or the insulation layer and/or the at least one contacting element is applied with a layer thickness of at least 1 μm.

9. The method according to claim 1, wherein the electric conductor elements and/or the contacting elements are applied with an aspect ratio of at least 1.

10. The method according to claim 1, wherein the substrate features a recess for passing an atomic beam or such a recess is introduced into the substrate.

11. An atom trap, produced according to a method according to claim 1, wherein the atom trap comprises at least one electric conductor element applied by electro-chemical deposition and/or a lift-off method, and at least one contacting element applied by electro-chemical deposition and/or a lift-off method, and the at least one electric conductor element and the at least one contacting element has a layer thickness of at least 1 μm and an aspect ratio of at least 1.

* * * * *